US006582254B2

(12) United States Patent
Arakawa et al.

(10) Patent No.: US 6,582,254 B2
(45) Date of Patent: Jun. 24, 2003

(54) SLIMLINE CRT SOCKET

(75) Inventors: Hiroharu Arakawa, Toyama-ken (JP); Atsushi Arai, Toyama-ken (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/117,662

(22) Filed: Apr. 4, 2002

(65) Prior Publication Data

US 2002/0160664 A1 Oct. 31, 2002

(30) Foreign Application Priority Data

Apr. 26, 2001 (JP) ..... 2001-130254

(51) Int. Cl.[7] ..... H01R 33/76
(52) U.S. Cl. ..... 439/683
(58) Field of Search ..... 439/683, 682, 439/684, 934

(56) References Cited

U.S. PATENT DOCUMENTS 4,565,420 A * 1/1986 Brunn ..... 439/683
6,019,642 A * 2/2000 Nagata ..... 439/683
6,305,988 B1 * 10/2001 Arakawa et al. ..... 439/683

* cited by examiner

*Primary Examiner*—Gary Paumen
*Assistant Examiner*—James R. Harvey
(74) *Attorney, Agent, or Firm*—Darby & Darby

(57) ABSTRACT

A CRT socket has reduced thickness but maintains favorable insulation without requiring a change in the construction of the neck of a CRT. The CRT socket arrays a plurality of signal and focusing contact sockets about a central hole. The ends of signal pins of a CRT and of the focusing contact sockets passing partly through an enlarged hole in a circuit board, whereby the height of the CRT socket is reduced.

5 Claims, 5 Drawing Sheets

PRIOR ART

SLIMLINE CRT SOCKET

BACKGROUND OF THE INVENTION

1. Field of the Invention

The present invention relates to a CRT (cathode ray tube) socket and, more particularly to a construction that is effective in reducing the thickness of a CRT (Cathode Ray Tube) socket that connects a CRT to a color television set, a display monitor, or the like.

2. Description of the Related Art

CRTs are widely used in color television sets and display monitors. While there is a demand for CRTs with wider screens and higher resolutions, there is also a demand for reduction in the depth of such devices.

FIG. 4 is a perspective drawing showing a conventional CRT socket 101. FIG. 5 is a cross-sectional view of the terminal pins of a CRT and the connecting portion of a CRT socket.

The CRT socket 101 has a cylindrical central hole 105 passing through it from its front face to its rear face. The CRT socket 101 includes a ring-shaped portion 102 that is concentric with and surrounding the cylindrical central hole 105. A cover portion 103 is fitted over a base portion 104 with the rear face of the cover portion 103 corresponding to the rear face of the base portion 104. A pair of focus contacts 107, into which the high-voltage focusing terminal pins of a CRT are inserted to connect the pins, are located at positions on the cover portion 103 that are concentric with the central cylindrical hole 105. Signal contact holes 106, into which the low-voltage signal terminal pins are inserted to connect the pins, are also provided at positions on the ring-shaped portion 102 that are concentric with the central cylindrical hole 105.

A CRT, or "Braun tube" as it is sometimes called, is a glass tube whose inside is a near vacuum. As shown by the dot-dot-dash line in FIG. 5, a CRT has a neck portion 100 containing an electron gun. A stem base 100*c* is provided so that a vacuum sealing portion 100*d* covers the end of the neck portion 100. Focusing terminal pins 100*a* and signal terminal pins 100*b* for the electron gun are also provided. The focusing terminal pins 100*a* are connected to focus contacts 172 of the CRT socket. The signal terminal pins 100*b* are connected to signal contacts 162.

The voltage applied to the signal terminal pins is relatively low, with a magnitude of 0 to 1000V. On the other hand, a high voltage in a range of 5 kV to 10 kV is applied to the focusing terminal pins. In order to electrically insulate the surrounding parts from the focusing terminal pins, the focusing terminal pins are surrounded by an insulating resin wall 142.

As a result, when attempting to reduce the thickness of the CRT socket, sufficient insulation is required for the focusing terminal pins. Making the focusing terminal pins shorter can easily result in problems affecting the quality of the electric connection of the focusing terminal pins and can make it necessary to reassess the manufacturing method of a CRT. This problem has complicated the task of making further reductions in the thickness of a CRT socket.

OBJECTS AND SUMMARY OF THE INVENTION

According to the above, it is an object of the invention to provide a CRT socket that is thinner while avoiding the drawbacks of the prior art.

It is a further object of the invention to provide a CRT socket construction that enables the thickness of the CRT socket to be reduced while maintaining favorable insulation, without requiring a change in the neck of a CRT.

According to an embodiment of the invention, there is provided a slimline CRT socket, comprising: a ring-shaped portion that has a cylindrical central hole passing therethrough from a front face to a rear face thereof, a plurality of concave signal contact housings in the rear face of the ring-shaped portion at positions that are concentric with the cylindrical central hole, signal contacts in a different one of the signal contact housing, and signal contact holes on the front face of the ring-shaped portion to allow signal terminal pins of a CRT to be inserted into the corresponding signal contact housings so as to connect the signal terminal pins to the signal contacts; a cover portion; the cover portion includes a focus contact housing formed as a concave in a rear face thereof, a focus contact in the focus contact housing, and a focus contact hole that allows a focusing terminal pin of the CRT to be inserted so that the focusing terminal pin is connected to the focus contact; and a base portion corresponding to the rear face of the cover portion, wherein a concave focusing terminal pin housing that houses the focusing terminal pin is disposed on the base portion, the focusing terminal pin housing concave passing through a surface of a board that is attached to the CRT socket and projecting outward from an opposite surface thereof.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
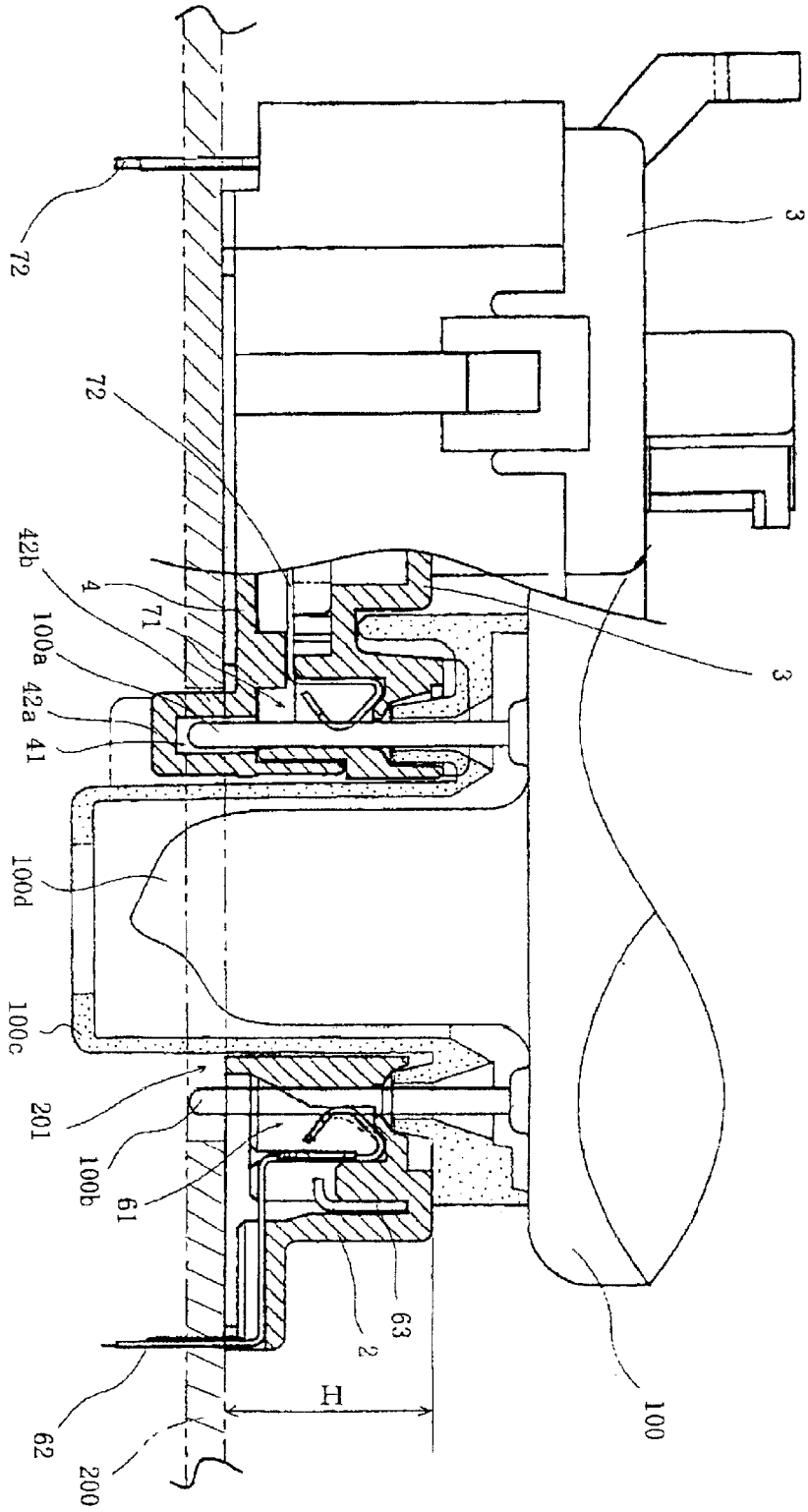
FIG. 1 is a cross-sectional view showing the main parts of a CRT socket according to the present invention.
Figure 4:
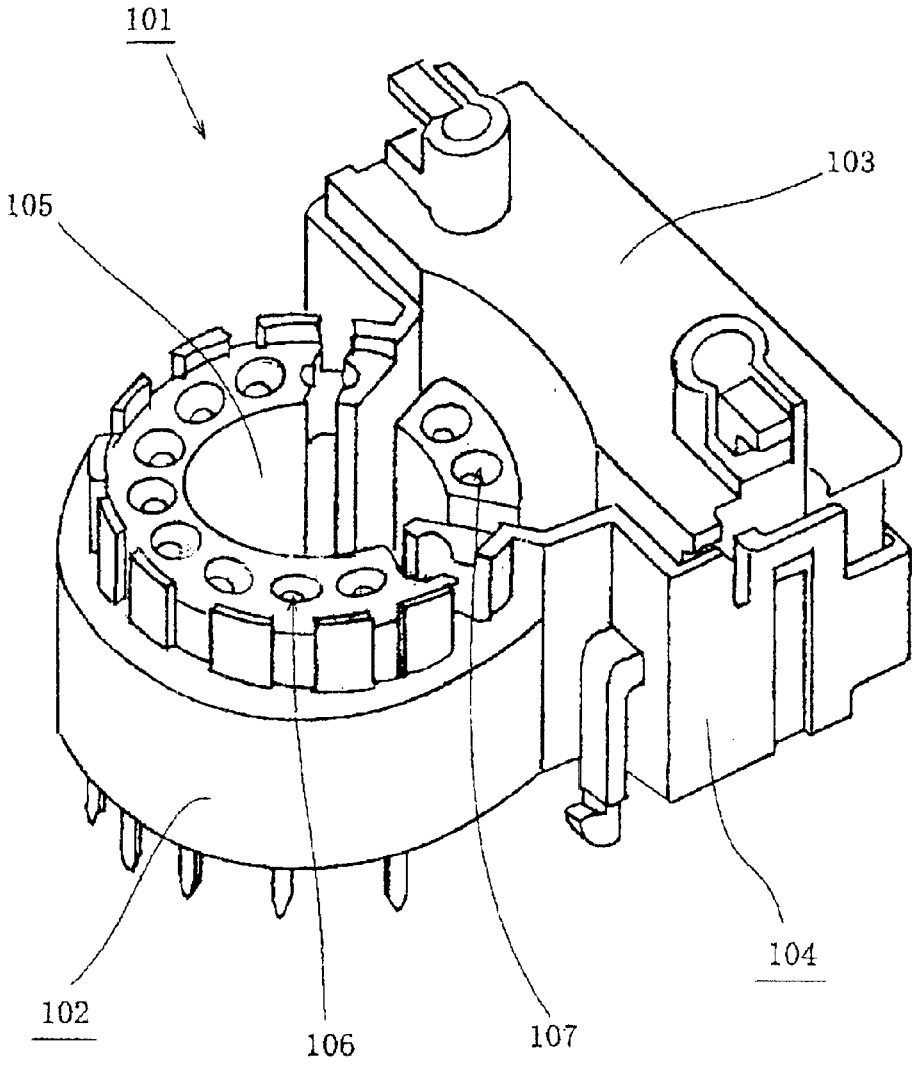
Fig. 4 PRIOR ART
FIG. 4 is a perspective view of a conventional CRT socket.
Figure 5:
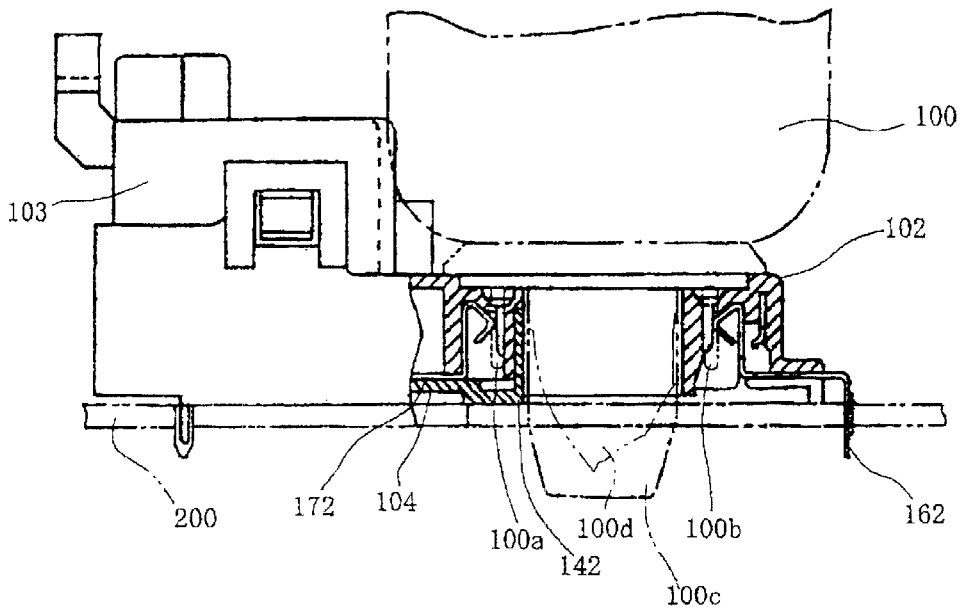
FIG. 5 is a cross-sectional view showing the main parts of a conventional CRT socket.

Referring now to FIG. 1, a CRT socket according to an embodiment of the invention includes an insertion hole 201 in a circuit board 200 that is slightly larger than that in the prior-art device of FIGS. 4 and 5. The increased size of the insertion hole 201 allows the stem base 100*c* to pass through. The increased size also allows a focusing terminal pin housing portion to pass through the insertion hole 201 and to project outward from the opposite side of the circuit board 200. The focusing terminal pin housing portion houses the end of a focusing terminal pin. The focusing terminal pin housing portion is formed on the base portion on the side of the circuit board that is attached to the CRT socket. By this change the height H is reduced, as, measured from the circuit board 200, in which the CRT is engaged.

It should be noted that the signal terminal pins 100*b* of a CRT are also arranged within the insertion hole 201.

Figure 2:
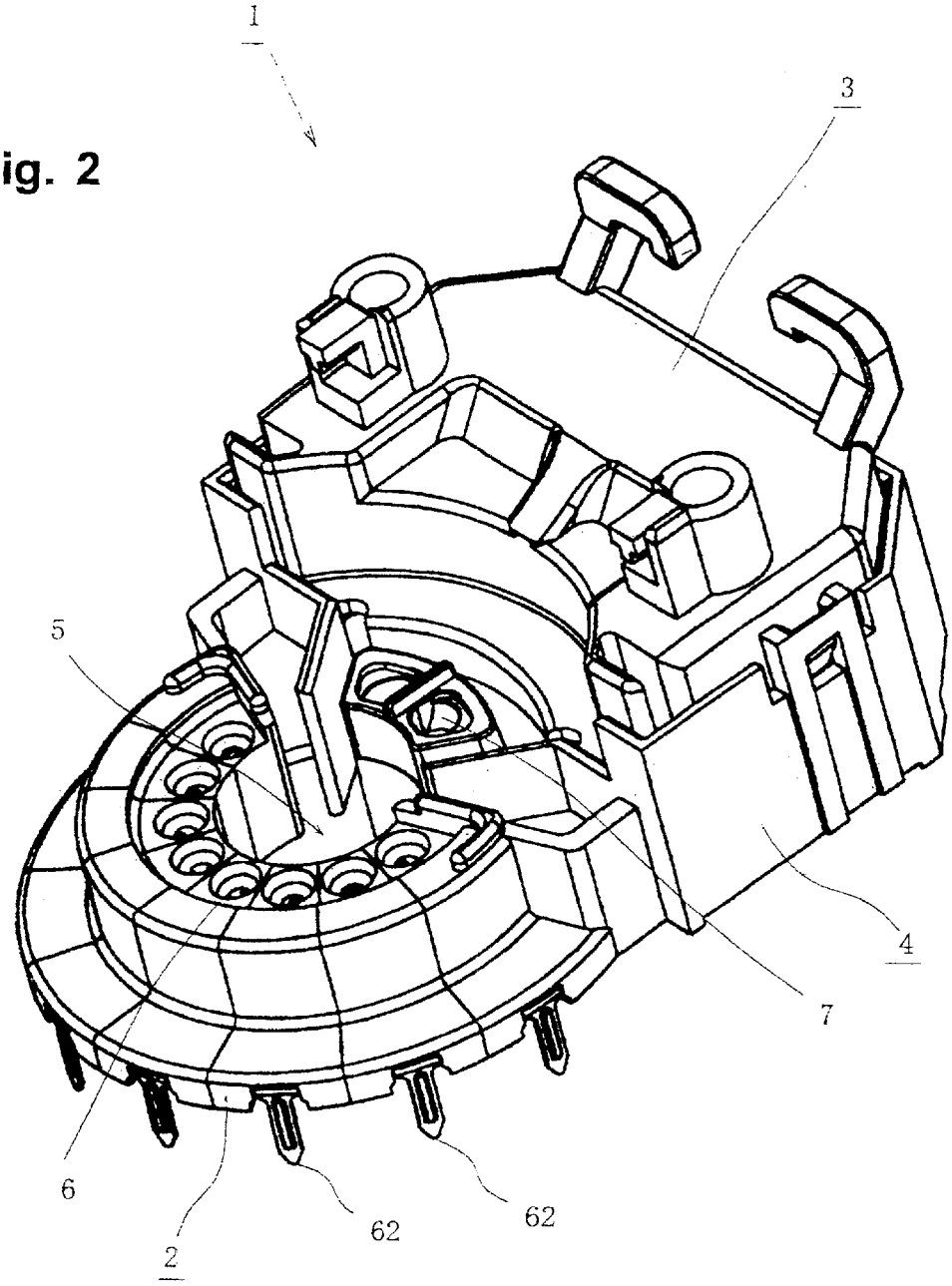
FIG. 2 is a perspective view showing the front of the CRT socket 1.

Referring now to FIG. 2, the front of a CRT socket 1 according to the present invention is shown. In the present disclosure, the term "the front" denotes the side that is connected to the terminal pins of a CRT.

Figure 3:
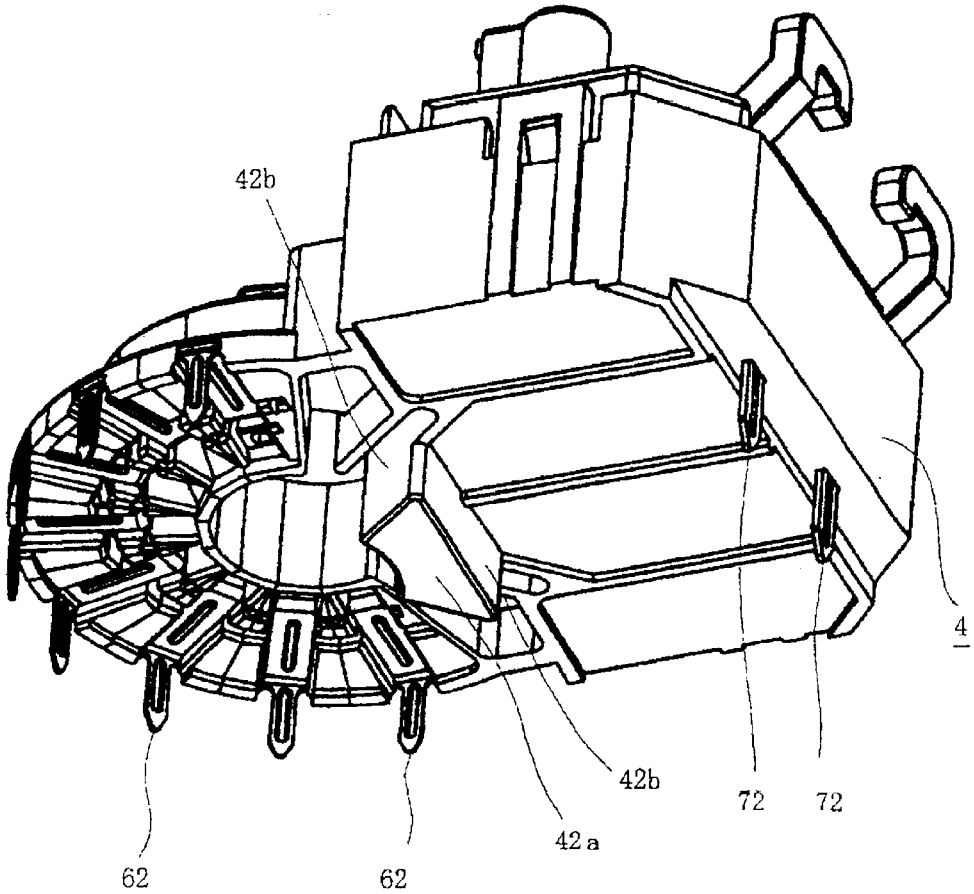
FIG. 3 is a perspective view showing the rear of the CRT socket 1.

Referring now also to FIG. 3, the rear of the CRT socket 1 is shown. In the present disclosure, the term "the rear" denotes the side on which a circuit board is attached.

The CRT socket 1 according to the present invention is composed of a ring-shaped portion 2, a cover portion 3, and a base portion 4. A central cylindrical hole 5 passes through the ring-shaped portion. The ring-shaped portion 2 is produced by injection molding a synthetic resin with a plurality of concave signal contact housings 61 arranged on its rear side at positions on the outside of, and concentric with, the central cylindrical hole 5. Signal contacts 62 are preferably conductive metal plates in the signal contact housings 61. Ground metal contacts 63 are positioned near the signal contacts 62 with a predetermined discharge gap between them. With this construction, the application of an abnormally high voltage results in electricity being discharged from the signal contacts 62 to the adjacent ground metal contacts 63, and thence to the outside.

Signal contact holes 6, into which the signal terminal pins 100*b* of a CRT are inserted and connected, are disposed about the front of the ring-shaped portion 2 concentrically with the central cylindrical hole 5. The signal contact holes 6 are aligned with the signal contact housings 61 mentioned above.

The cover portion 3 houses conductors such as focus contacts 72 to which a high voltage is applied. The cover portion 3 is formed of resin so as to cover the base portion. Focus contact housings 71 are formed as concaves on a rear side of the part of the cover portion that corresponds to the ring-shaped portion 2. One focus contact 72 is mounted in each focus contact housing 71. On the front side of the cover portion 3, focus contact holes 7 are aligned at positions corresponding to the focus contact housings 71, approximately concentric with the signal contact holes 6.

A focusing terminal pin housing concave 41 composed of a housing concave bottom 42*a* and side walls 42*b* is provided on the base portion 4 so as to house the ends of the focusing terminal pin 100*a* of a CRT that are inserted into the focus contact holes 7 and connected therein. This housing concave is attached at an edge of an insertion hole 201 in the printed circuit board 200.

In the present embodiment, the cover portion and the ring-shaped portion may be formed integrally or as separate components.

While the above explanation is for a CRT with two focus terminal pins, the present invention may be adapted for use with a CRT with a single focusing terminal pin.

When the construction of the present invention is used, the ends of the focusing terminal pins of a CRT are surrounded by a housing that is formed so as to project outward beyond the rear of the base portion and to pass through the circuit board at the corresponding position. This means that a reduction can be made in the height (measured from the circuit board) at which a CRT engages a CRT socket without having to shorten the terminal pins of the CRT. A corresponding reduction can therefore be made in the thickness of the CRT socket.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A slimline CRT socket, comprising:

a ring-shaped portion having a cylindrical central hole passing therethrough from a front face to a rear face thereof;

a plurality of concave signal contact housings in a rear face of said ring-shaped portion at positions that are concentric with said cylindrical central hole;

signal contacts, each in a different one of said signal contact housings;

signal contact holes provided on a front face of said ring-shaped portion to allow signal terminal pins of a CRT to be inserted into the corresponding signal contact housings thereby to permit connection of said signal terminal pins to said signal contacts;

a cover portion;

said cover portion having a concave focus contact housing in a rear face thereof;

a focus contact in said focus contact housing;

a focus contact hole in said focus contact housing;

said focus contact hole allowing a focusing terminal pin of said CRT to be inserted so that said focusing terminal pin is connected to said focus contact;

a base portion corresponding to said rear face of said cover portion;

a concave focusing terminal pin housing that houses said focusing terminal pin on said base portion; and said focusing terminal pin housing passing through a surface of a board that is attached to said CRT socket and projecting outward from an opposite surface thereof.

2. A CRT socket for attachment to a circuit board, comprising:

signal terminals fittable to said circuit board for connection to external circuits;

signal contacts for receiving signal pins of a CRT;

a focusing terminal pin housing passing through one surface of said circuit board and passing beyond an opposite surface thereof; and means in said focusing terminal pin housing for permitting connection of a focusing terminal pin thereto, whereby a height of said CRT socket is reduced.

3. A CRT socket according to claim 2 wherein said signal pins, when installed, pass at least partly through said circuit board.

4. A CRT socket comprising:

a plurality of signal pin contacts surrounding a first opening in said socket;

at least one a focusing terminal pin socket adjacent said first opening;

ends of CRT signal pins, when installed, passing at least partly through a second opening in a circuit board to which said CRT socket is mounted; and said at least one focusing terminal pin socket passing at least partly through said second opening, whereby a height of said CRT socket above a surface of said circuit board is reduced.

5. A CRT socket according to claim 4, wherein said second opening is substantially larger than said first opening.

* * * * *